United States Patent [19]

Salmon

[11] Patent Number: 4,902,022

[45] Date of Patent: Feb. 20, 1990

[54] GAME APPARATUS INCLUDING FREE FLOATING GAME ELEMENTS

[75] Inventor: James E. Salmon, North Vancouver, Canada

[73] Assignee: Fanstick Products International, Inc., Vancouver, Canada

[21] Appl. No.: 291,910

[22] Filed: Dec. 29, 1988

[51] Int. Cl.[4] ..... A63B 67/00

[52] U.S. Cl. ..... 273/317; 273/428

[58] Field of Search ..... 273/317, 327, 353, 412, 273/424, 425, 428, 1 R, 1 L

[56] References Cited

U.S. PATENT DOCUMENTS

| | | | |
|---|---|---|---|
| D. 70,800 | 7/1926 | McDonald | D21/51 |
| D. 213,123 | 1/1969 | Anderson | D21/51 |
| 2,129,489 | 9/1938 | Brown | 273/412 X |
| 2,147,502 | 2/1939 | Savage | 273/353 X |
| 2,286,368 | 6/1942 | May | 273/1 R X |
| 3,017,192 | 1/1962 | Milan | 273/1 R |
| 3,107,095 | 10/1963 | Cairns | 273/428 X |
| 3,601,398 | 8/1971 | Brochman | 273/DIG. 4 X |
| 4,149,723 | 4/1979 | Simon | 273/428 X |

*Primary Examiner*—William H. Grieb

*Attorney, Agent, or Firm*—Townsend and Townsend

[57] ABSTRACT

An improved game apparatus is described. The game apparatus includes a plurality of game pieces that have been constructed to be tossed into the air and to float to the ground while the "Player" picks them from their airborne flight to accumulate points. One embodiment of the invention utilizes a resilient rubber ball as a timing device. The ball is thrown into the air or otherwise allowed to drop to the ground surface simultaneously with the game elements being made airborne. The game elements are plucked from the air before the ball can again contact the ground surface N times.

16 Claims, 3 Drawing Sheets

GAME APPARATUS INCLUDING FREE FLOATING GAME ELEMENTS

BACKGROUND OF THE INVENTION

The present invention relates generally to game apparatus, and more particularly to game apparatus including a plurality of game pieces constructed, configured and adapted to be tossed into the air and fall to the ground, and while so falling may be plucked from the air to accumulate points.

There has been available to humanity, for some time, a common game called "Jacks." The game apparatus of a Jacks game typically comprises a plurality of similarly shaped game pieces (themselves called "Jacks") and a resilient (e.g., rubber) ball. The game is played by first scattering the game pieces within a predetermined area. The ball is then dropped, and allowed to fall toward the ground surface to initiate bouncing. The game pieces are picked from the ground surface before the ball again contacts the ground surface one or more times.

The conventional Jacks game, as described above, has provided children, and occasionally adults, with many hours of enjoyment for many years. In addition to the enjoyment it provides, the Jacks game, like many other games, can function to improve the dexterity and eye/hand coordination of growing children. Even so, it is believed that the game has become so common that it is not as attractive as it once was.

In addition, the game poses relative dangers to younger children: The Jacks game pieces are capable of causing serious injury if swallowed. For this reason, parents have often prohibited younger children access to the enjoyment that can be provided by the Jacks game.

SUMMARY OF THE INVENTION

The present invention provides game apparatus that is safer than the conventional Jacks game, yet is inexpensive and can provide many hours of enjoyment, as well as possibly improve the dexterity and eye/hand coordination of those who play.

According to the present invention, there is provided a plurality of game pieces that are fabricated in a manner that makes them "floatable" when thrown into the air. While the game pieces can be of any number of various configurations, they are preferably constructed in a manner that will allow them to "hold" the air, allowing them to float to the ground rather than plummet.

In the preferred embodiment of the invention, the game pieces are formed from a lightweight, polyethylene foam material. Some are provided a configuration that allows them to catch the air, providing a floating action as it falls to the ground; other game pieces are constructed with less such aerodynamic qualities so that they will fall faster to the ground.

The game pieces are generally flat in nature, although in an alternate embodiment a foam dowel-like structure can be inserted in, to protrude through, the game piece so that it can be picked from the ground easily.

The game pieces may be variously shaped and configured to denote points that can be accumulated. In game play, the game pieces are thrown into the air, and as they float or otherwise fall to the ground, a player plucks them from the air to accumulate points denoted by their configuration. A resilient spheroid (e.g., rubber ball) can be used, as in the conventional Jacks game, to designate the time period for picking the game pieces from the air.

There are a number of advantages achieved by the present invention. First, because it is preferably made from polyethylene foam, the game apparatus can be constructed with a minimum of expense. Further, there is a modicum of safety in the event the game pieces may be inadvertently swallowed.

A further advantage of the invention is the challenge to one's manual dexterity and eye/hand coordination presented by the moving targets (i.e., the game pieces) as they freefall to the ground. These and other further advantages of the present invention will become apparent to those skilled in this art upon a reading of the following description of the invention, which should be taken in conjunction with the accompanying drawings.

DETAILED DESCRIPTION OF THE INVENTION

Figure 1:
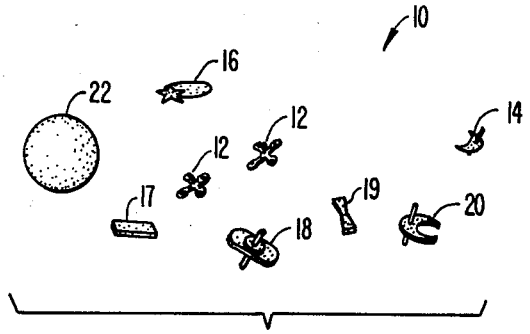
FIG. 1 illustrates the present invention in the form of a plurality of game pieces, showing also a small spheroid used to form an alternate embodiment of the invention.

Referring now to the Figures, and in particular FIG. 1, there is illustrated the game apparatus, designated generally with the reference numeral 10, comprising a plurality of game pieces 12–20. A preferred form of the game apparatus consists only of the plurality of game pieces 12–20. FIG. 1, however, also illustrates an alternate form of the game comprising the game pieces 12–20 together with a ball 22.

Preferably, the game pieces 12–20 are variously shaped, and are fabricated from a lightweight material, so that when the game pieces are dropped from a height above a surface (e.g., ground), they will tend to "hold" the air during their freefall to, in effect, "float" from the height to the ground. Although only one or two game pieces of any one configuration is shown, it will be understood that this is for illustrative purposes only, and that there preferably are a number of game pieces of each configuration for game play.

Each of the game pieces are constructed from flat sheets of approximately one eighth inch thick polyethylene foam material, thereby providing each game piece with a generally planner, or flat, dimension. That is, certain of the game pieces, as will be seen, are constructed with an aerodynamic characteristic so that, when falling, they will twirl or otherwise take longer to fall than others without such a characteristic to thereby enhance their "floating" effect. As FIGS. 2–10 illustrate, the game pieces 12–20 have various configurations so that certain groups of the game pieces can be distinguishable from other of the game pieces, although other indicia may be used for such purpose (e.g., color, markings, etc..). This allows the game pieces to take on point values that may be accumulated during play.

The ball 22 is preferably fabricated from a resilient material, such as rubber, so that it will bounce when dropped or otherwise allowed to fall to a smooth surface. So constructed, the game pieces 12–20 are adapted to be thrown into the air, or otherwise dropped from a height, to allow players to pluck them from the air (one at a time, or as many as can be grabbed) during their freefall downward. If the game apparatus 10 includes the ball 22, then the ball is allowed to drop or otherwise propelled substantially simultaneously with the tossing of the game pieces 12–18 into the air. The ball is used as a timing device. That is, the ball 22 may be dropped simultaneously with the launch of the game pieces 12–20 into the air. A player or players may pluck the following game pieces from the air until the ball 22 bounces one or more times, at which time the plucking period ends.

As will be evident to those skilled in this art, there can be derived a number of game play variations from the object of the basic game described above. One such variation presently preferred would proceed along the following lines:

The game pieces may be divided up equally among the players, depending on the number of players, or alternatively the players use a certain number of the game pieces as each takes a turn. Initially, a determination is made as to the sequence of game play, and who begins that sequence. This can be done by allowing each player to toss a predetermined number of the game pieces 12–20 into the air, and attempting to catch as many as possible (perhaps using both hands) before they hit an underlying surface. The player who catches the most game pieces becomes the first in the sequence of play; the player who, during his turn, grabs the second greatest number of game pieces going next in the sequence; and so on.

Game play begins with the first player launching the allotted game pieces 12–20 to allow them to fall through the air, preferably by tossing them as high as possible into the air. While the game pieces 12–20 are airborne, the player attempts to catch or otherwise "capture" as many as possible before they land. Points can be scored for each game piece captured. Preferably, the game pieces 12–20 can have varying point designations according to their configuration or other indicia.

Each captured game piece will entitle a player to a re-toss. Accordingly, the uncaptured game pieces are picked up, and re-tossed into the air. Again, the player attempts to capture them as they fall, this time using only the same hand. In this re-toss, all captured game pieces are worth a lesser number of points than in the first round. If more than one re-toss was earned on the first round, then subsequent retosses are made, using only remaining game pieces each time.

When the first player has either captured all of the game pieces, or finished all the re-tosses earned from the first toss, his or her score may then be totaled and play passes to the next player in the sequence who proceeds along the same line of play.

Play continues until a certain score is reached (e.g., 1000 points or more), at which time the game ends.

Using the alternate embodiment of the game apparatus, i.e., including the ball 22, play proceeds the same as that described above. The difference being that once game play is started, the ball 22 is used to time the period during which the game pieces 12–20 may be plucked from the air while they fall. Thus, in addition to tossing the game pieces 12–20 into the air, the game ball 22 is also tossed and must be caught after the first bounce. If it is not, no game pieces are considered captured.

Scoring is the same as that described above without use of the ball 22. Two hands may be used throughout the game played with game apparatus 12–20 and ball 22.

The ball must be tossed and caught on each turn, and the game pieces 12–20 and ball 22 are thrown into the air simultaneously. As many as possible are caught before the ball bounces twice. The ball must be caught on the first bounce in order for captured points to be scored.

As indicated above, the game pieces 12–20 can take on any shape or configuration, but preferably they are shaped so as to present a wind resistant profile that enhances their capability of floating as they freefall to the ground after being tossed into the air. FIGS. 2–10 illustrate various configurations found to be advantageous in forming certain of the game pieces 12–20.

Figure 2A:
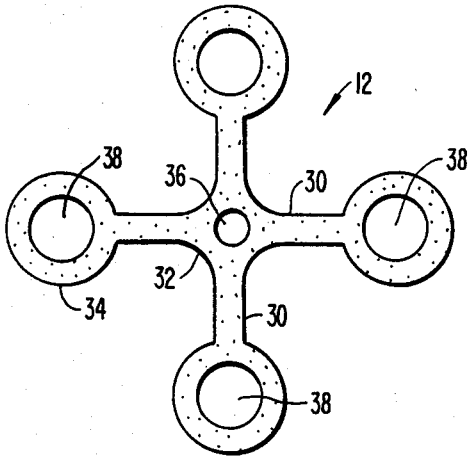
FIG. 2A–10 illustrates in greater detail the various configurations that the game pieces illustrated in FIG. 1, shapes and as well as alternate embodiments of those configurations.
Figure 2B:
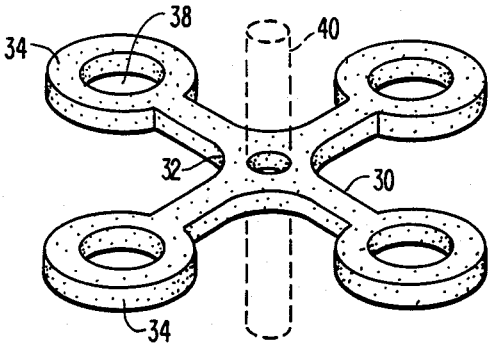

Referring now to FIGS. 2A–2C, there is illustrated one of the configurations of the game pieces 12–20 of the present invention. As indicated above, the game pieces are preferably fabricated from a planner polyethylene foam material, having a thickness of approximately one eighth inch. As illustrated in FIG. 2A, the game pieces 12 are formed having a number of (shown here as 4) radially extending appendages 30 that emanate from a central area 32 and terminate in a circular portion 34. Formed generally in the center of the area 32 is an aperture 36. In addition, if desired, each of the circular terminal portions 34 have formed therein apertures 38.

The aperture 36 is formed and configured to receive therethrough a dowel element 40, illustrated (in phantom) in FIG. 2B. The dowel element 40 is preferably made from the same lightweight polyethylene foam material as that used to form the game piece 12 (and game pieces 14–20). The aperture 36 is preferably formed and configured so that when the dowel element 40 is inserted therein, the longitudinal dimension of the dowel element is aligned substantially to the planner dimension of game piece 12.

The dowel element 40 is believed to add additional air resistance to the game piece 12, as well as making the game piece easier to pick up from a surface. However, the game piece 12 may be used with or without the dowel element 40 as desired. As will be seen, other of the game pieces 14–20 are also provided apertures for receiving the dowel element 40. As with game piece 12, these other game pieces may also be used with or without the dowel element 40.

Figure 3B:
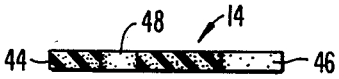
Figure 3A:
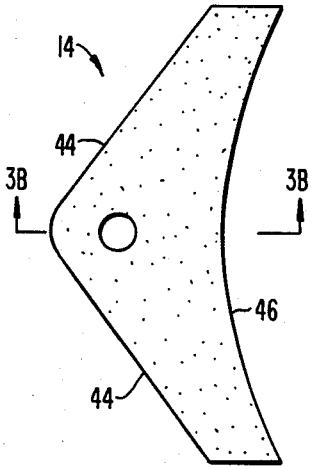

Turning now to FIGS. 3A–3B, the configuration of game pieces 14 are illustrated. As shown, the game pieces 14 are generally configured in a swept back wing type shape. In illustrated in FIG. 3B, the configuration of game piece 14 includes tapering the game piece from a thicker dimension of the leading edges 44 to the trailing edge 46. This tapering is believed to add an aerodynamic characteristic or quality to the game piece 14, increasing its wind resistant profile. This aerodynamic quality causes the game piece to fall slower through the air, enhancing its floating capability. In addition, the game piece 14 is formed therein an aperture 48 for receiving a dowel element 40, if desired.

Figure 4A:
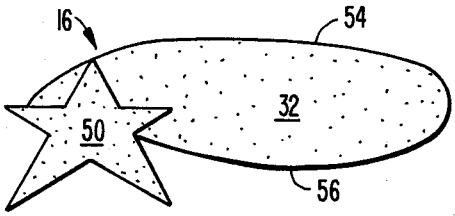
Figure 4B:
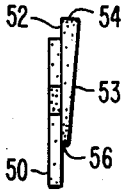
Figure 4C:
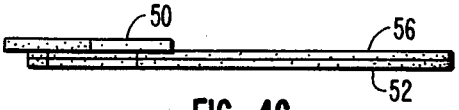

FIGS. 4A–4C illustrate the configuration and shape of game pieces 16, formed from a stylistic star shaped element 50 affixed to a somewhat elliptical shaped element 52. Preferably, the underside 53 of the elliptical shaped element 52 is tapered from a thicker edge 54 to a thinner edge 56, as illustrated in FIG. 4B. This tapering, as with the game pieces 14 (FIG. 3A–3B), provides an aerodynamic characteristic to the game piece 16, so that, when tossed into the air or otherwise allowed to drop in freefall from a height, the game piece 16 will twirl and float downward.

Figure 5A:
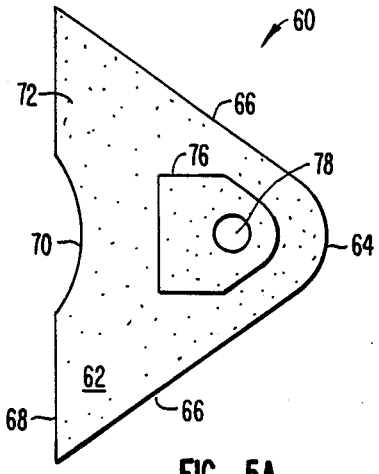
Figure 5C:
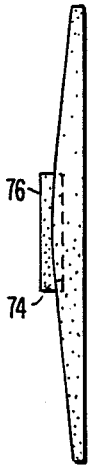
Figure 5B:
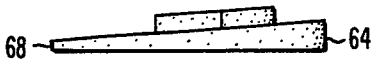

Turning now to FIGS. 5A–5C, yet another game piece configuration is illustrated. As shown, the game piece, designated here generally with the reference numeral 60, includes a somewhat triangular body portion 62, having an arcuate nose section 64 from which edges 66 extend to a back edge 68. Formed in the back edge 68 is an arcuate recess 70. One planner surface 72 of the body portion 62 is recessed at 74 (FIG. 5C) to receive element 76. Both element 76 and periphery of the recess of 74 are similarly configured for a snug fit. Formed both through the body portion 62 and the element 76 is an aperture 78 for receiving the dowel element 40 (not shown in FIG. 5A–5C; see FIG. 2B).

The body portion 62 is tapered from the nose section 64 to the back edge 68 so that the nose section of the body portion is thicker than the back edge (FIGS. 5B and 5C). This tapering, as similar tapering did for the game piece elements 14 and 16 (FIG. 3–4) provide the game piece 60 with a aerodynamic characteristic that is believed to improve its wind resistant profile.

Preferably, the game pieces 12–20 will (and game pieces having a shape game piece 60–FIG. 5) be formed to have an aerodynamic characteristic that exhibits a smaller wind resistant profile than other of the game pieces. In this way certain of the game pieces 12–20 will not float as well when tossed into the air, and will fall at a greater rate of speed than other of the game pieces. This improves the enjoyment of the game; the faster falling game pieces can be denoted as having a higher point designation than the slower falling game pieces.

Figure 6:
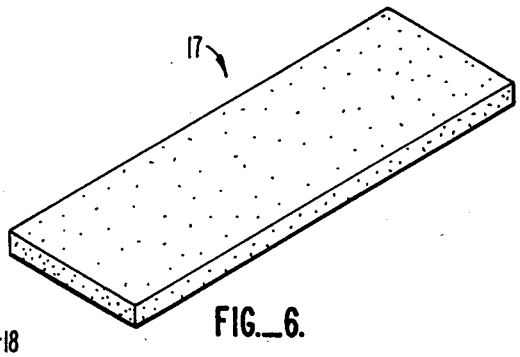
Figure 7:
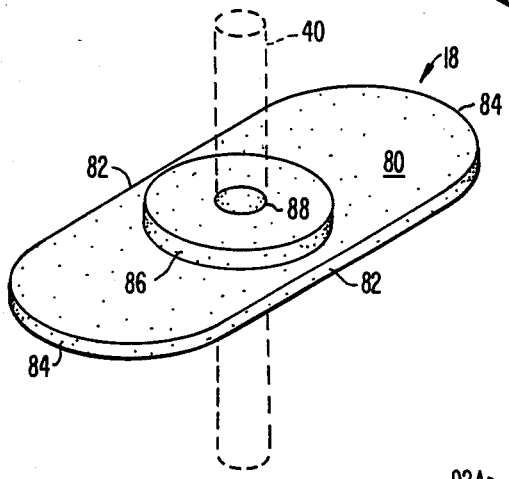

According to this latter feature of the invention, game pieces 17, 18, 19, and 20 (FIGS. 6–9) are provided. FIG. 6 illustrates games pieces 18 as being generally a planner rectangle of polyethylene foam. FIG. 7 illustrates a configuration for the game pieces 18 as being generally oval with parallel linear sides 82 extending between arcuate shaped ends 84. Generally concentric and central of the body portion 80 is a second generally oval element 86 affixed to one surface of the body portion 80. Preferably formed through the body portion 80 and the second portion 86 affixed thereto, is an aperture 88 for removably receiving a dowel element 40 (illustrated in phantom), if desired.

Figure 8:
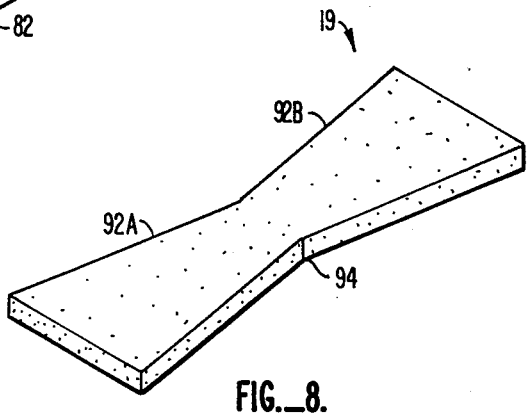

FIG. 8 illustrates the further configurations of game pieces 19. As shown, the configuration is generally a pair of coplaner triangles 92A and 92B joined near their apexes at 94.

Figure 9:
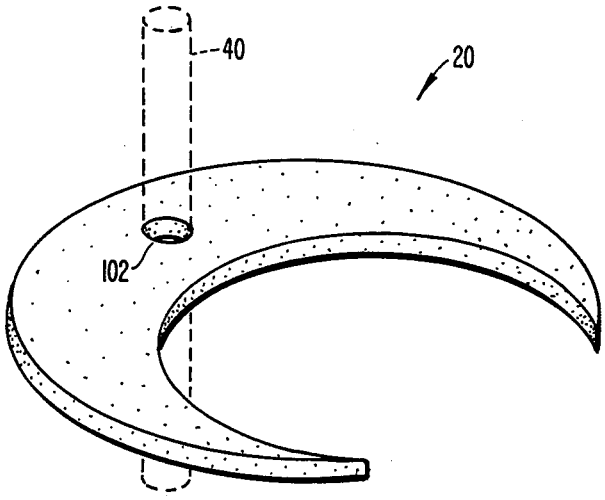

FIG. 9 shows game pieces 20 having a planner, half-moon configuration. Formed in a central region of the game piece 20 is an aperture 102 for receiving the dowel element 40 (shown in phantom).

Figure 10:
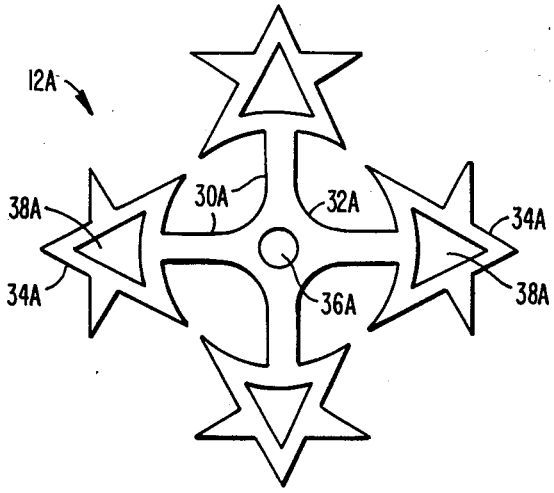

Finally, FIG. 10 illustrates a stylized version of the game piece 12 configuration illustrated in FIGS. 2A–2B. Here, the game piece 12 is modified and shown as game piece 12A. Game piece 12 A is formed to have appendages 30A extending from a central area 32A, and terminating in stylized, star-like configurations 34A. If desired, as shown, each of the star-like terminations can have triangularly shaped apertures 38A formed therein.

Finally, the central area 32A of the game piece 12A has formed therein an aperture 36A configured to receive, if desired, a dowel element 40.

In summary, there has been disclosed game apparatus comprising a plurality of game pieces structured and configured to be tossed into the air and fall to the earth. One form of the game apparatus comprises only game pieces. In yet another form of the game apparatus, there is included a resilient spheroid in the form of a preferably rubber ball.

While those skilled in the art will readily recognize that the subject invention is capable of being modified, the true scope and content of the invention is described in the appendant claims.

I claim:

1. Game apparatus, comprising:

a plurality of game pieces, each of the game pieces being formed of a lightweight material and configured to have an aerodynamic characteristic that provides each of the plurality of game pieces with a wind-resistant profile to cause each of the game pieces to affect a floating action when allowed to fall freely through the air toward the earth;

the plurality of game pieces including first and second numbers of game pieces, the first number of game pieces being substantially identically shaped and configured and of a configuration different from that of the second number of game pieces; and a resilient spheroid.

2. The game pieces of claim 1, wherein a plurality of game pieces are formed of a polyethylene foam.

3. The game apparatus of claim 1, wherein the configuration of the first and second number of game pieces denote points.

4. The game apparatus of claim 1, wherein the resilient spheroid is formed from a rubber material.

5. Game apparatus, comprising:

plurality of game pieces, each of the game pieces being formed from a lightweight material, and each being configured in a manner that enhances a floating effect when allowed to freefall through the air, the plurality of game pieces including a first number of game pieces being substantially identically configured to one another, and of a first configuration, and a second number of game pieces being substantially configured to one another and of a second configuration that is different from the first configuration; and a resilient spheroid.

6. Game apparatus of claim 5, wherein the game pieces each have a generally planner dimension.

7. The game apparatus of claim 6, wherein the game pieces are fabricated from a polyethylene foam material.

8. A Jacks game apparatus of the type including a bounceable, rubber ball and a plurality of game pieces, the improvement comprising:

Each of the game pieces being fabricated from a lightweight, polyethylene foam material and having a generally planer dimension;

The plurality of game pieces including a number of first and second game pieces, the first game pieces being configured to identify them as being first or second game pieces, and shaped to enhance a floating effect when dropped and allowed to fall to the ground.

9. The Jacks game apparatus of claim 8, wherein each of the first number of game pieces have a configuration substantially identical to one another.

10. The Jacks game apparatus of claim 9, wherein each of the second number of game pieces have a configuration substantially identical to one another and different from that of the first number of game pieces.

11. The Jacks game apparatus of claim 10, wherein certain of the plurality of game pieces are configured to have an aerodynamic characteristic so that when allowed to drop and freefall to the ground the certain of the plurality of game pieces will move in the air in response to the aerodynamic characteristics.

12. The Jacks apparatus of claim 11, wherein ones of the certain of the plurality of game pieces have a section that is tapered to provide said aerodynamic characteristic configuration.

13. The Jacks game apparatus in claim 8, wherein certain of the plurality of game pieces have an aperture formed therethrough;

A number of elongated dowel elements, one for each of the plurality of game pieces, each of the dowel being formed and configured to be inserted in and protrude through the aperture formed in each of the certain of the plurality of game pieces.

14. The Jacks game apparatus of claim 13, wherein the number elongated dowel elements are each fabricated from the same material as the certain of the plurality of game pieces.

15. The Jacks game apparatus of claim 14, wherein each of the elongated dowel elements has a substantially cylindrical configuration.

16. The Jacks game apparatus of claim 15, wherein the aperture formed in each of the certain of the plurality of the game pieces is configured to hold the corresponding elongated dowel element in a substantially normal relation of the planner dimension of the associated game piece.

* * * * *